US009370811B2

(12) United States Patent
Luckey, Jr. et al.

(10) Patent No.: US 9,370,811 B2
(45) Date of Patent: Jun. 21, 2016

(54) METHOD OF CALIBRATING AN EXTRUDED STRAIGHT TUBE

(71) Applicant: Ford Global Technologies, LLC, Dearborn, MI (US)

(72) Inventors: S. George Luckey, Jr., Dearborn, MI (US); Andrey M. Ilinich, Dearborn, MI (US); John Joyce, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 293 days.

(21) Appl. No.: 13/894,490

(22) Filed: May 15, 2013

(65) Prior Publication Data

US 2014/0338414 A1 Nov. 20, 2014

(51) Int. Cl.

| | |
|---|---|
| ***B21C 23/00*** | (2006.01) |
| ***B21C 35/03*** | (2006.01) |
| ***B21C 23/14*** | (2006.01) |

(52) U.S. Cl.

CPC ..... *B21C 23/00* (2013.01); *B21C 23/142* (2013.01); *B21C 35/03* (2013.01)

(58) Field of Classification Search

CPC ..... B21D 3/00; B21D 3/10; B21D 3/12; B21D 1/14; B21D 1/145; B21D 3/14; B21D 3/16; B21D 11/02; B21D 11/14; B21C 23/00; B21C 35/04; B21C 23/142; B21C 35/023; B21C 35/03; B21C 1/16; B21C 23/12

USPC ..... 72/296, 302, 306

See application file for complete search history.

(56) References Cited

U.S. PATENT DOCUMENTS

| | | | | |
|---|---|---|---|---|
| 2,927,372 | A * | 3/1960 | Powell | 72/84 |
| 3,400,567 | A * | 9/1968 | Sirantoine | 72/299 |
| 4,970,886 | A | 11/1990 | Sikora et al. | |
| 5,735,160 | A | 4/1998 | VanSumeren et al. | |
| 5,737,953 | A | 4/1998 | Allison et al. | |

* cited by examiner

*Primary Examiner* — Teresa M Ekiert

(74) *Attorney, Agent, or Firm* — Raymond L. Coppielli; Brooks Kushman P.C.

(57) ABSTRACT

A method and tool for calibrating an extruded tube for use in a manufacturing operation. According to the method, the tube is stretched while in a clamping tool by approximately 3%. The tool encloses the tube while a stretching mechanism is clamped to opposite longitudinal ends of the tube and applies a stretching force to opposite ends of the tube. The tool includes a clamping mechanism that clamps the tube into a cavity and a stretching mechanism with clamps that are attached to opposite longitudinal ends of the tube to calibrate the tube by longitudinally stretching the tube.

15 Claims, 2 Drawing Sheets

METHOD OF CALIBRATING AN EXTRUDED STRAIGHT TUBE

TECHNICAL FIELD

This disclosure relates to a tool and a method of calibrating an extruded straight tube.

BACKGROUND

Vehicle manufacturers are implementing lighter, stronger materials, such as aluminum alloys to meet emission reduction goals, meet fuel economy goals, reduce manufacturing costs, and reduce vehicle weight. Increasingly demanding safety standards must be met while reducing vehicle weight. One approach to meeting these competing interests and objectives is to use aluminum extrusions with complex profiles.

Extrusion lineals having complex, non-round cross-sections are typically extruded from an aluminum billet through a porthole extrusion die at a high temperature and at high pressure. Discontinuous material flow across the section of the shape occurs when the flowing aluminum separates in the mandrel plate and re-converges in the cap section of the porthole extrusion die. The extruded structural tubes are cooled after extruding. Extruded structural tubes tend to twist, lack straightness and may be otherwise deformed during cooling and may be out of conformance with part specifications. The lineals may be extruded in lengths exceeding 100 ft. Those lengths are then stretched up to 5 percent to straighten and reduce twist to within industrially accepted Aluminum Association dimensional limits. Stretching in accordance with Aluminum Association limits does not sufficiently correct the tolerances for automotive use. The lineals are cut to a reduced length as required for the final product, a specified manufacturing blank, or for shipping The cross-section of extruded tubes is constant along the length of the lineal. A significant advantage of extrusion technology is the flexibility to tailor the cross-section design to include multi-hollow sections having external flanges, internal ribs defining multiple cavities, and varied thickness across the section. Such flexibility supports the design of weight efficient cross-sections with high section stiffness. These tubes are typically used in front and rear bumpers, crash boxes, sports car front headers, and a-pillars.

Such parts usually have a sweeping single-axis or multi-axis bend along the length of the part which may be achieved by stretch-bending the extruded lineal tube. Stretch bending can be done with stretch-bend tooling in a press or a hydraulic, purpose-built stretch-bending machine. In stretch-bending, the straight extruded tube blank is gripped at the ends of the tube. The tooling then moves to simultaneously stretch and bend the tube onto a one-sided, matched tooling. This process serves to both shape (sweep) the part along the length as well as improve the tolerance of the component to a level acceptable for automotive applications. This type of bending action cannot be utilized for an extrusion part that is designed to be straight in an automotive application. Although stretching and bending together can improve dimensional tolerances, stretching alone is not sufficient to correct the dimensional tolerances of a straight tube to meeting automotive tolerance requirements.

This disclosure is directed to solving the above problems and other problems as summarized below.

SUMMARY

According to one aspect of this disclosure, a method of straightening an extruded tube is disclosed that comprises opening a tool that defines a cavity, placing the extruded tube in the cavity, and closing the tool over the tube. A small clearance space is defined between the tube and the cavity. A first clamp is applied to a first end of the tube and a second clamp is applied to second end of the tube. The tube is stretched in a longitudinal direction to straighten the tube and minimize any twists in the tube.

According to an alternative embodiment of this disclosure, a method of making a tubular blank is disclosed. The method comprises the steps of extruding an aluminum alloy through a die to form an extruded tube. The tube is cut to a predetermined length. A tool defines a cavity and has an open position and a closed position is placed in the open position for the tube to be loaded into the tool. The tool is then closed over the tube with the tube and the cavity defining a clearance space between the tube and the cavity. A first clamp is applied to a first end of the tube and a second clamp is applied to second end of the tube. The tube is stretched in a longitudinal direction to minimize twists in the tube and form the tubular blank to a calibrated linear configuration.

According to other aspects of either of the above described embodiments of the method, the extruded tube may further comprise an elongated extruded tube having a plurality of interior walls within an outer wall. The clearance space between the tube and the cavity may be between 0.025 mm and 0.5 mm. The tube may be stretched from 1% to 4% in length, or in another embodiment, the tube may be stretched 3% in length. The tool extends in the longitudinal direction and encloses the tube along the length of the tube (excluding the end portions). The tube may have at least one flange extending outward from an outer wall of the tube.

According to another aspect of this disclosure, a calibration tool is provided for straightening a linear port hole extruded tube. The calibration tool comprises a first part of the tool defining a first part of a cavity and a second part of the tool defining a second part of the cavity. A clamping mechanism opens the tool to allow the tube to be placed in the cavity. The clamping mechanism is closed to clamp the tube between the first and second parts of the tool. A stretching mechanism grips two ends of the tube and stretches the tube longitudinally while the clamping mechanism is closed.

According to other aspects of this disclosure that relates to the tool, the extruded tube may further comprise an elongated extruded tube having a plurality of interior walls within an outer wall. The first and second parts of the cavity may define a space between the tube and the cavity that is between 0.025 mm and 0.5 mm when the clamping mechanism is closed. The stretching mechanism may be used to stretch the tube from 1% to 4% in length. Alternatively, the tool may be used to stretch the tube 3% in length. The first and second parts of the tool may extend in the longitudinal direction and enclose the tube along the length of the tube. The tube may have at least one flange extending outward from an outer wall of the tube.

The above aspects of this disclosure and other aspects will be described in greater detail below in the detailed description of the illustrated embodiments with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
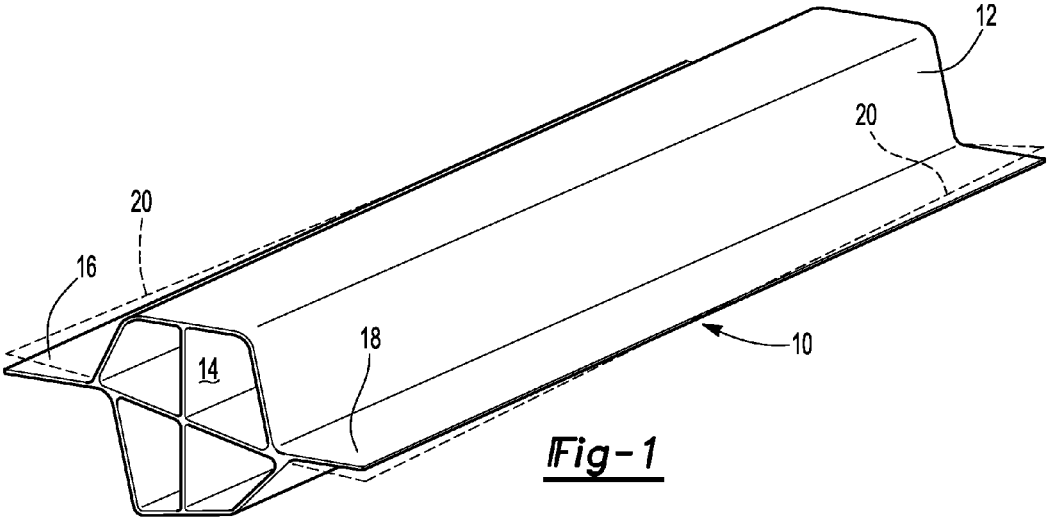
FIG. 1 is a perspective view of an extruded tube that is in a twisted condition.

Referring to FIG. 1, an extruded tube 10 is shown prior to the stretched calibration operation disclosed in this application. The tube 10 includes an outer wall 12 and a plurality of inner walls 14. A first flange 16 and a second flange 18 are provided on opposite sides of the tube 10. The phantom lines 20 shown in FIG. 1 illustrate the desired shape of the tube 10. The solid lines illustrating a first flange 16 and a second flange 18 are twisted in a longitudinal direction and are out of tolerance.

Figure 2:
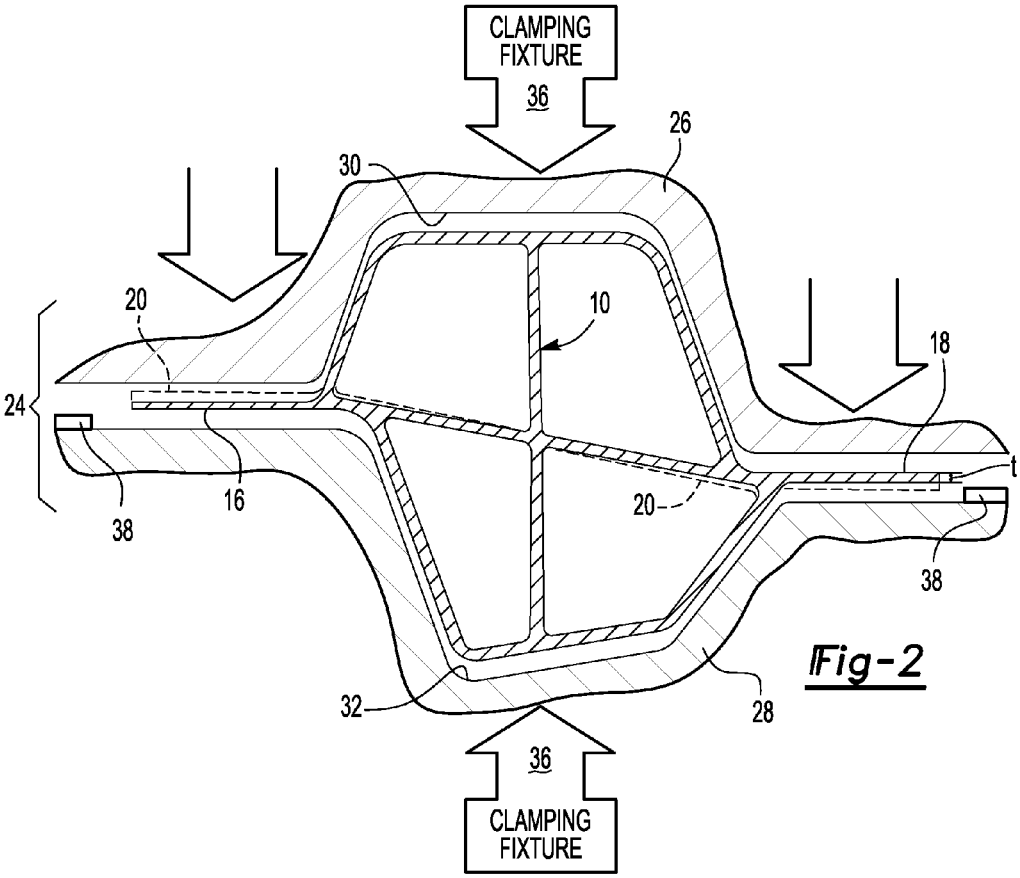
FIG. 2 is a schematic view of a tool in the process of clamping a twisted extruded tube.

Referring to FIG. 2, the extruded tube 10 is generally indicated by reference numeral 10 and is disposed in a stretch calibration tool 24 that may be used to calibrate the tube 10. A first part 26 of the tool 24 and the second part 28 of the tool 24 are shown with the extruded tube 10. The arrows in FIG. 2 show first part 26 being moved toward the second part 28 of the tool 24. It should be understood that both parts 26 and 28 may be movable or that the second part 28 may move instead of moving the first part 26, as illustrated. The first part 26 defines a first part 30A of a cavity 30 and the second part 28 defines a second part 30B of the cavity 30. A clearance space 32 is provided between the extruded tube 10 and the cavity 30. A clamping fixture 36 may operate on one or both of the first and second parts 26 and 28 of the stretch calibration tool 24. The clamping fixture 36 closes the tool 24 over the tube 10, but is not clamped fully against the tube 10.

One or more shims 38 are provided to limit the extent that the tube 10 is clamped in the stretch calibration tool 24. The shims 38 may be separate parts or may be integrally formed as part of the tool 24. Reference letter "t" indicates the thickness of the flange 18. Shims 38 having a thickness of t+ between 0.025 mm and 0.5 mm are placed between the first and second parts 26 and 28 of the tool 24. The shims 38 prevent the first and second parts 26 and 28 from tightly engaging the tube 10 against the first and second parts of the cavity 30.

Figure 3:
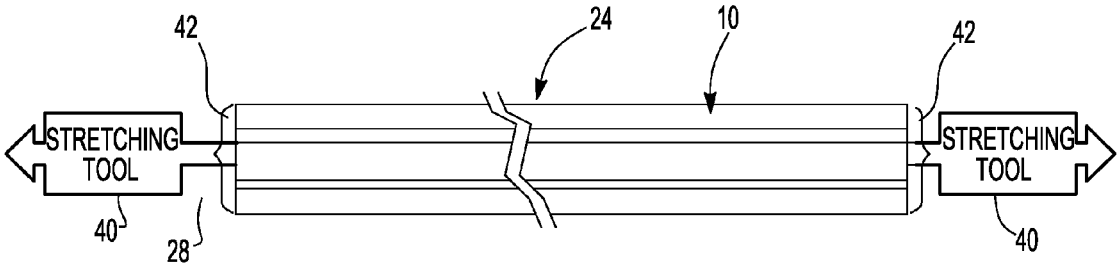
FIG. 3 is a diagrammatic view of an extruded straight tube in a calibration tool before stretching.

Referring to FIG. 3, the tube 10 is shown disposed in a stretch calibration tool 24. As shown, the first part 26 is removed, for better visibility, and the tube 10 is shown disposed on the second part 28 of the stretch calibration tool 24. A stretching tool 40 is attached to each of the opposite longitudinal ends of the tube 10 by a set of end clamps 42. The end clamps 42 are pulled in opposite longitudinal directions by the stretching tool 40. The stretching tool 40 may be a mechanical, hydraulic or pneumatic tool that applies oppositely directed forces to the tube 10.

Figure 4:
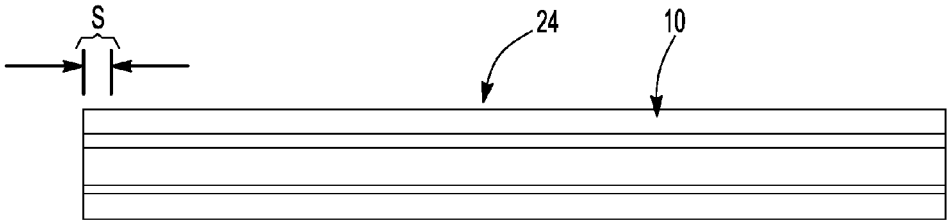
FIG. 4 is a diagrammatic view of an extruded straight tube in a calibration tool after stretching.

Referring to FIG. 4, the tube 10 is shown disposed in the stretch calibration tool 24 with an indication at "s" of the extent to which tube 10 shown in FIG. 3 is stretched by the stretching tool 40. The extent of stretching may be between 1% and 4% or in one embodiment the tube is stretched 3% in length by the action of the stretching tool 40. The stretching tool 40 acts on the tube 10 while the first and second parts 26 and 28 are clamped with a small clearance space of approximately 0.1 mm being provided between the tube 10 and the first part 30A and second part 30B of the cavity 30.

Figure 5:
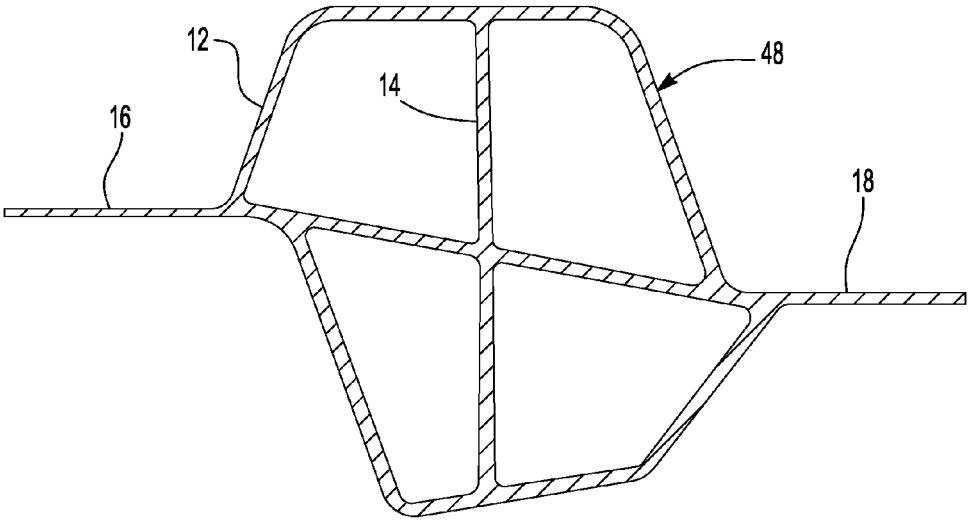
FIG. 5 is a cross-sectional view of an extruded tube after stretch calibration.

Referring to FIG. 5, the result of the stretch calibration tool 24 operation is a straightened linear extruded tube 48. The extruded tube 48 is in calibration and any twist or other deformation is reduced or eliminated to meet part specifications.

The clearance 32 between the tube 10 and the first part 30A and second part 30B of the cavity 30 is limited to about 0.1 mm in one embodiment. Alternatively, the first part 30A and second part 30B of the cavity 30 may be coated with a lubricant. The tube 10 while clamped by the clamping fixture 36 between first part 26 and second part 26 of the stretch calibration tool 24 are not tightly clamped against the tube 10. The clearance 32, with or without lubricant, is provided to permit the stretching tool 40 to stretch the length of the extruded tube 10 while remaining clamped in the stretch calibration tool 24.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:

placing an extruded tube in an openable cavity defined by a tool, wherein the tube is fully contained within the cavity except for a first end and a second end of the tube, and wherein a shim prevents the tool from tightly engaging the tube with a clearance being defined between the tube and the cavity;

applying a first clamp to the first end of the tube and a second clamp to the second end of the tube; and stretching the tube in a longitudinal direction to straighten the tube.

2. The method of claim 1 wherein the extruded tube further comprises an elongated extruded tube having a plurality of interior walls that define a plurality of closed cells within an outer wall.

3. The method of claim 1 wherein the tube has a flange with a thickness "t", and wherein the clearance between the tube and the cavity is "t"+between 0.025 mm and 0.5 mm.

4. The method of claim 1 wherein the tube is stretched from 1% to 4% in length.

5. The method of claim 1 wherein the tube is stretched 3% in length.

6. The method of claim 1 wherein the tube has at least one flange extending outwardly from an outer wall of the tube.

7. A calibration tool for straightening a linear extruded tube, comprising:

a first part of the tool defining a first part of a cavity;

a second part of the tool defining a second part of the cavity;

a clamping mechanism opens the tool to permit the tube to be placed in the cavity and closes the tool against a shim to clamp and enclose the tube along a length of the tube between a first clamp and a second clamp except where the first and second clamps are applied to the tube; and a stretching mechanism grips two ends of the tube and stretches the tube longitudinally with the clamping mechanism closed.

8. The calibration tool of claim 7 wherein the extruded tube further comprises an elongated extruded tube having a plurality of interior walls within an outer wall that define a plurality of closed cells.

9. The calibration tool of claim 7 wherein the shim between first and second parts of the tool define a clearance space between the tube and the cavity with the clamping mechanism closed to prevent the first and second parts from tightly engaging the tube.

10. The calibration tool of claim 7 wherein the stretching mechanism stretches the tube from 1% to 4% in length.

11. The calibration tool of claim 7 wherein the stretching mechanism stretches the tube 3% in length.

12. The calibration tool of claim 7 wherein the tube has at least one flange extending outwardly from an outer wall of the tube.

13. A method of making a tubular blank for a manufacturing operation comprising:

extruding an aluminum alloy through a die to form an extruded tube having a flange having a thickness "t";

cutting the tube to a length;

opening a tool that defines a cavity, wherein the tool has an open position and a closed position;

loading the tube into the tool in the open position;

closing the tool over the tube, wherein a shim having a thickness "t"+0.025 mm and 0.5 mm defines a clearance space between the tube and the cavity, and wherein the entire length of the tube is disposed within the cavity;

applying a first clamp to a first end of the tube and a second clamp to second end of the tube; and stretching the tube in a longitudinal direction to straighten the tube and form the tubular blank to a calibrated straight shape.

14. The method of claim 13 wherein the tube further comprises an elongated tube having a plurality of interior walls that define a plurality of closed cells within an outer wall.

15. The method of claim 13 wherein the tube is stretched from 1% to 4% in length.

* * * * *